US009468813B2

(12) United States Patent
Tachibana et al.

(10) Patent No.: US 9,468,813 B2
(45) Date of Patent: Oct. 18, 2016

(54) GOLF BALL

(71) Applicant: DUNLOP SPORTS CO. LTD., Kobe-shi, Hyogo (JP)

(72) Inventors: Kosuke Tachibana, Kobe (JP); Kazuya Kamino, Kobe (JP); Takahiro Sajima, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/752,427

(22) Filed: Jun. 26, 2015

(65) Prior Publication Data

US 2015/0375054 A1 Dec. 31, 2015

(30) Foreign Application Priority Data

Jun. 27, 2014 (JP) ..... 2014-131997

(51) Int. Cl.
*A63B 37/06* (2006.01)
*A63B 37/00* (2006.01)

(52) U.S. Cl.
CPC ..... *A63B 37/0075* (2013.01); *A63B 37/0006* (2013.01); *A63B 37/0021* (2013.01); *A63B 37/0033* (2013.01); *A63B 37/0043* (2013.01); *A63B 37/0092* (2013.01); *A63B 37/0012* (2013.01)

(58) Field of Classification Search
CPC ..... A63B 37/0006; A63B 37/0031
USPC ..... 473/378
See application file for complete search history.

(56) References Cited

U.S. PATENT DOCUMENTS 5,688,194 A * 11/1997 Stiefel ..... A63B 37/0004 33/1 G
2002/0010039 A1* 1/2002 Ogg ..... A63B 37/0004 473/383
2007/0149321 A1 6/2007 Sajima
2007/0173354 A1 7/2007 Sajima
2007/0298908 A1 12/2007 Sajima
2008/0039236 A1* 2/2008 Isogawa ..... A63B 37/0004 473/378

(Continued)

FOREIGN PATENT DOCUMENTS

JP 8-257167 A 10/1996
JP 2008-389 A 1/2008

(Continued)

*Primary Examiner* — Raeann Gorden
(74) *Attorney, Agent, or Firm* — Birch, Stewart, Kolasch & Birch, LLP

(57) ABSTRACT

A golf ball 2 includes a core 4, a mid layer 6, a cover 8 and a paint layer 10. The core 4 includes a center 12 and an envelope layer 14. The golf ball 2 satisfies the following mathematical formulas. In the mathematical formulas, Hm represents a Shore D hardness of the mid layer, Hc represents a Shore D hardness of the cover, and Hb represents a Shore D hardness of the surface of the golf ball. The golf ball 2 has a large number of dimples 16 on a surface thereof. The number of planes that can divide a pattern of the dimples so that divided patterns are mirror symmetry to each other is one.

$Hc \leq 49$ $Hm - Hc \geq 15$ $Hm - Hb \leq 2$

14 Claims, 8 Drawing Sheets

(56) References Cited

U.S. PATENT DOCUMENTS

| | | | | |
|---|---|---|---|---|
| 2008/0188327 | A1 | 8/2008 | Tapper et al. | |
| 2009/0102097 | A1* | 4/2009 | Sajima | A63B 37/0004 264/299 |
| 2009/0191982 | A1 | 7/2009 | Kim et al. | |
| 2010/0190584 | A1* | 7/2010 | Sajima | A63B 37/0004 473/384 |
| 2011/0034274 | A1* | 2/2011 | Sajima | A63B 37/0006 473/384 |
| 2012/0004053 | A1 | 1/2012 | Kim | |
| 2013/0053180 | A1* | 2/2013 | Isogawa | A63B 37/0003 473/373 |
| 2013/0196791 | A1 | 8/2013 | Sajima et al. | |
| 2013/0324323 | A1 | 12/2013 | Yontz | |

FOREIGN PATENT DOCUMENTS

| | | | |
|---|---|---|---|
| JP | 2008-161582 | A | 7/2008 |
| JP | 2010-188199 | A | 9/2010 |
| JP | 2013-31778 | A | 2/2013 |

* cited by examiner

GOLF BALL

This application claims priority on Patent Application No. 2014-131997 filed in JAPAN on Jun. 27, 2014. The entire contents of this Japanese Patent Application are hereby incorporated by reference.

BACKGROUND OF THE INVENTION

1. Field of the Invention

The present invention relates to golf balls. Specifically, the present invention relates to golf balls that include a core, a mid layer, a cover and dimples.

2. Description of the Related Art

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

There have been various proposals for dimples. US2007/0149321 (JP2007-175267) discloses a dimple pattern in which the number of units present in a high-latitude region is different from the number of units present in a low-latitude region. US2007/0173354 (JP2007-195591) discloses a dimple pattern in which the number of types of dimples present in a low-latitude region is greater than the number of types of dimples present in a high-latitude region. US2013/0196791 (JP2013-153966) discloses a dimple pattern in which the density of dimples is high and variations in sizes of dimples are small. US2009/0191982 (JP2009-172192) discloses a golf ball that has randomly arranged dimples. The dimple pattern of the golf ball is referred to as a random pattern. US2012/0004053 (JP2012-10822) also discloses a golf ball having a random pattern.

Golf players require not only flight performance but also controllability for golf balls. A proposal for achieving both flight performance and controllability was made in JP2010-188199. A similar proposal was also made in JP2013-31778.

If a golf ball is hit with an iron, an excessive lift force is generated. The lift force may cause rising of the golf ball during flight. The rising is the cause of variations in flight distances. The golf ball is inferior in stability of flight distance. It is not easy for golf players to let the golf ball land on a target point.

An objective of the present invention is to provide a golf ball that is excellent in flight performance in a shot with a driver, flight distance stability in a shot with an iron, and controllability in an approach shot.

SUMMARY OF THE INVENTION

A golf ball according to the present invention includes a core, a mid layer positioned outside the core, and a cover positioned outside the mid layer. The golf ball satisfies the following mathematical formulas (1) to (3). The golf ball has a large number of dimples on a surface thereof. When the surface is divided into a northern hemisphere and a southern hemisphere, each of the hemispheres includes a high-latitude region, a mid-latitude region, and a low-latitude region. The high-latitude region has a latitude range of equal to or greater than 40° but equal to or less than 90°. The mid-latitude region has a latitude range of equal to or greater than 20° but less than 40°. The low-latitude region has a latitude range of equal to or greater than 0° but less than 20°. The number of planes that can divide a dimple pattern of the hemisphere so that divided dimple patterns are mirror symmetrical to each other is one. A dimple pattern of the high-latitude region is not rotationally symmetrical. A dimple pattern of the low-latitude region is not rotationally symmetrical.

$$Hc \leq 49 \quad (1)$$

$$Hm - Hc \geq 15 \quad (2)$$

$$Hm - Hb \leq 2 \quad (3)$$

In the mathematical formulas, Hm represents a Shore D hardness of the mid layer, Hc represents a Shore D hardness of the cover, and Hb represents a Shore D hardness of the surface of the golf ball.

The mid layer can be formed from a resin composition. Preferably, a principal component of a base resin in the resin composition is an ionomer resin. The cover can be formed from a resin composition. Preferably, a principal component of a base resin in the resin composition is polyurethane.

Preferably, the cover has a thickness Tc of equal to or less than 0.8 mm. Preferably, the thickness Tc of the cover is equal to or greater than 0.3 mm but equal to or less than 0.5 mm. Preferably, the hardness Hm is equal to or greater than 55.

Preferably, the golf ball satisfies the following mathematical formula (4).

$$0.6 \leq (Hm - Ho)/Hc \leq 1.5 \quad (4)$$

In the mathematical formula, Ho represents a Shore D hardness at a central point of the core.

Preferably, the golf ball satisfies the following mathematical formula (5).

$$Hm - Ho \geq 20 \quad (5)$$

In the mathematical formula, Ho represents a Shore D hardness at the central point of the core.

Preferably, a dimple pattern of the mid-latitude region is not rotationally symmetrical.

The high-latitude region may include a pole vicinity region. The pole vicinity region has a latitude range of equal to or greater than 75° but equal to or less than 90°. Preferably, a dimple pattern of the pole vicinity region is rotationally symmetrical.

The low-latitude region may include an equator vicinity region. The equator vicinity region has a latitude range of equal to or greater than 0° but less than 10°. Preferably, a dimple pattern of the equator vicinity region is rotationally symmetrical.

Preferably, a great circle that does not intersect any dimple does not exist on the surface of the golf ball.

Preferably, a ratio of a total area of all the dimples to a surface area of a phantom sphere of the golf ball is equal to or greater than 80%.

DESCRIPTION OF THE PREFERRED EMBODIMENTS

The following will describe in detail the present invention based on preferred embodiments with reference to the accompanying drawings.

Figure 1:
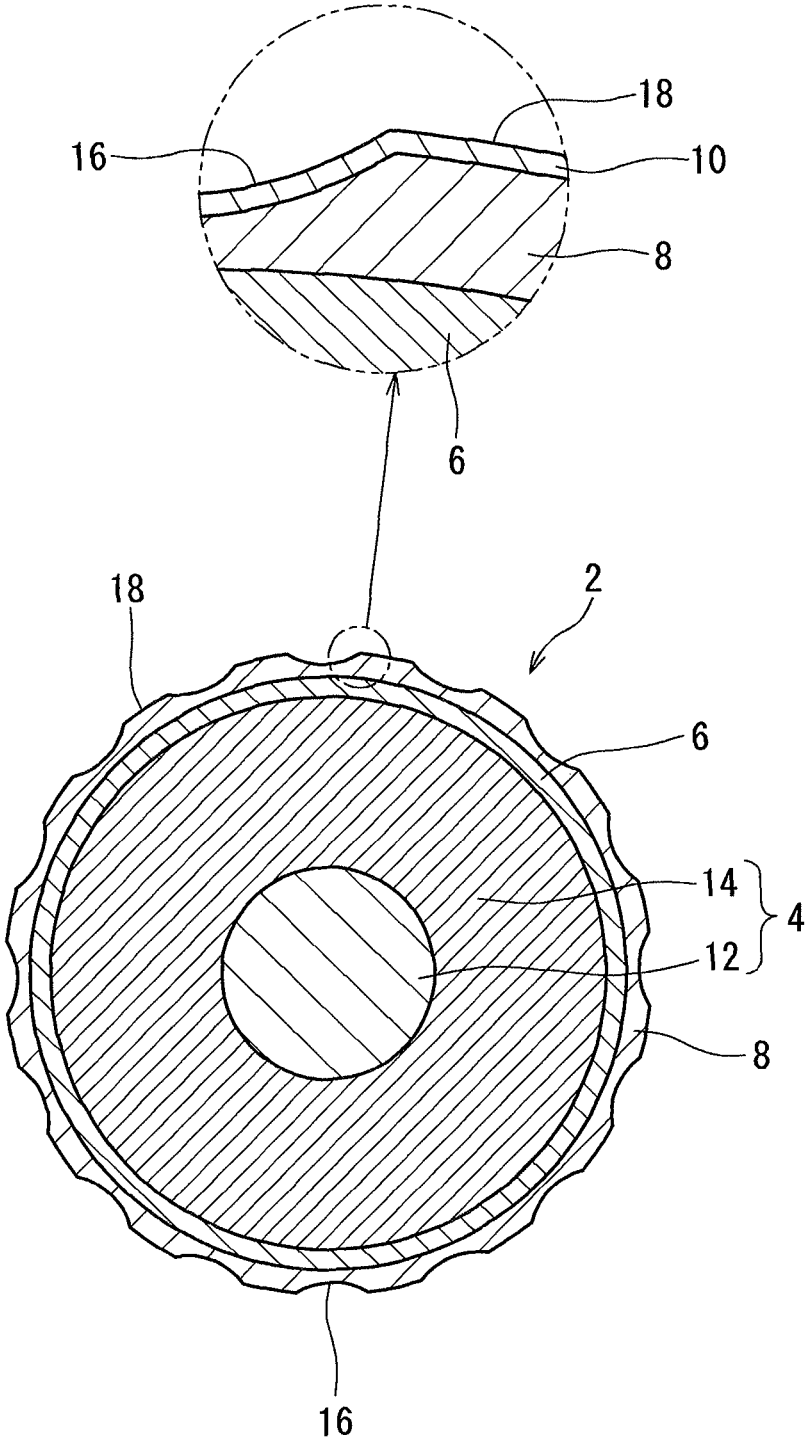
FIG. 1 is a schematic cross-sectional view of a golf ball according to an embodiment of the present invention.

FIG. 1 is a partially cutout cross-sectional view of a golf ball 2 according to one embodiment of the present invention. The golf ball 2 includes a spherical core 4, a mid layer 6 positioned outside the core 4, a cover 8 positioned outside the mid layer 6, and a paint layer 10 positioned outside the cover 8. The core 4 includes a spherical center 12 and an envelope layer 14 positioned outside the center 12. The golf ball 2 may include a mark layer on the internal side of the paint layer 10. The golf ball 2 may include a mark layer on the external side of the paint layer 10. The golf ball 2 may include another layer between the envelope layer 14 and the mid layer 6. The golf ball 2 may include another layer between the mid layer 6 and the cover 8.

The golf ball 2 has a large number of dimples 16 on a surface thereof. Of the surface of the golf ball 2, a part other than the dimples 16 is a land 18.

The golf ball 2 has a diameter of preferably 40 mm or greater but 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The center 12 is formed by crosslinking a rubber composition. Examples of the preferable base rubber of the rubber composition include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred that the polybutadiene is a principal component. Specifically, the proportion of the polybutadiene to the entire base rubber is preferably equal to or greater than 50% by weight and particularly preferably equal to or greater than 80% by weight. A polybutadiene in which the proportion of cis-1,4 bonds is equal to or greater than 80% is particularly preferred.

The rubber composition of the center 12 preferably includes a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

In light of resilience performance of the golf ball 2, the amount of the α,β-unsaturated carboxylic acid per 100 parts by weight of the base rubber is preferably equal to or greater than 10 parts by weight and particularly preferably equal to or greater than 15 parts by weight. In light of soft feel at impact, the amount is preferably equal to or less than 50 parts by weight and particularly preferably equal to or less than 45 parts by weight.

In light of resilience performance of the golf ball 2, the amount of the metal oxide per 100 parts by weight of the base rubber is preferably equal to or greater than 10 parts by weight and particularly preferably equal to or greater than 15 parts by weight. In light of soft feel at impact, the amount is preferably equal to or less than 50 parts by weight and particularly preferably equal to or less than 45 parts by weight.

The rubber composition of the center 12 may include a metal salt of an α,β-unsaturated carboxylic acid having 2 to 8 carbon atoms as a co-crosslinking agent. Examples of preferable co-crosslinking agents include zinc acrylate, magnesium acrylate, zinc methacrylate, and magnesium methacrylate.

Preferably, the rubber composition of the center 12 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. An organic peroxide with particularly high versatility is dicumyl peroxide.

In light of resilience performance of the golf ball 2, the amount of the organic peroxide per 100 parts by weight of the base rubber is preferably equal to or greater than 0.1 parts by weight, more preferably equal to or greater than 0.3 parts by weight, and particularly preferably equal to or greater than 0.5 parts by weight. In light of soft feel at impact, the amount is preferably equal to or less than 3.0 parts by weight, more preferably equal to or less than 2.8 parts by weight, and particularly preferably equal to or less than 2.5 parts by weight.

The rubber composition of the center 12 may include an organic sulfur compound. Examples of preferable organic sulfur compounds include monosubstitutions such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, and bis(4-cyanophenyl)disulfide; disubstitutions such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; trisubstitutions such as bis(2,4,6-trichlorophenyl)disulfide and bis(2-cyano-4-chloro-6-bromophenyl)disulfide; tetrasubstitutions such as bis(2,3,5,6-tetrachlorophenyl)disulfide; and pentasubstitutions such as bis(2,3,4,5,6-pentachlorophenyl)disulfide and bis(2,3,4,5,6-pentabromophenyl)disulfide. The organic sulfur compound contributes to resilience performance. Particularly preferable organic sulfur compounds are diphenyl disulfide and bis(pentabromophenyl)disulfide.

In light of resilience performance of the golf ball 2, the amount of the organic sulfur compound per 100 parts by weight of the base rubber is preferably equal to or greater than 0.1 parts by weight and particularly preferably equal to or greater than 0.2 parts by weight. In light of soft feel at impact, the amount is preferably equal to or less than 1.5 parts by weight, more preferably equal to or less than 1.0 parts by weight, and particularly preferably equal to or less than 0.8 parts by weight.

For the purpose of adjusting specific gravity and the like, a filler may be included in the center 12. Examples of suitable fillers include zinc oxide, barium sulfate, calcium carbonate, and magnesium carbonate. The amount of the filler is determined as appropriate so that the intended specific gravity of the center 12 is accomplished. According to need, various additives such as sulfur, an anti-aging agent, a coloring agent, a plasticizer, a dispersant, and the like are included in the rubber composition of the center 12 in an adequate amount. Crosslinked rubber powder or synthetic resin powder may also be included in the center 12.

The center 12 has a central hardness Ho of preferably equal to or greater than 25 but equal to or less than 50. The center 12 having a central hardness Ho of equal to or greater than 25 can achieve excellent resilience performance. In this respect, the central hardness Ho is more preferably equal to or greater than 30 and particularly preferably equal to or greater than 33. The center 12 having a central hardness Ho of equal to or less than 50 suppresses spin in a shot with a driver. In this respect, the central hardness Ho is more preferably equal to or less than 45 and particularly preferably equal to or less than 40. The central hardness Ho is measured by pressing a Shore D type hardness scale against the central point of the golf ball 2 divided in half. For the measurement, an automated rubber-hardness measurement machine (trade name "P1", manufactured by Kobunshi Keiki Co., Ltd.), to which this hardness scale is mounted, is used.

The center 12 has a diameter of preferably equal to or greater than 10 mm but equal to or less than 25 mm. The center 12 having a diameter of equal to or greater than 10 mm suppresses spin in a shot with a driver. In this respect, the diameter is more preferably equal to or greater than 12 mm, and particularly preferably equal to or greater than 14 mm. The golf ball 2 that includes the center 12 having a diameter of equal to or less than 25 mm is excellent in resilience performance. In this respect, the diameter is more preferably equal to or less than 20 mm, and particularly preferably equal to or less than 17 mm.

The center 12 has a weight of preferably equal to or greater than 10 g but equal to or less than 30 g. The temperature for crosslinking the center 12 is equal to or higher than 140° C. but equal to or lower than 180° C. The time period for crosslinking the center 12 is equal to or longer than 10 minutes but equal to or shorter than 60 minutes. The center 12 may include two or more layers. The center 12 may have a rib on the surface thereof. The center 12 may be hollow.

The envelope layer 14 is formed by crosslinking a rubber composition. Examples of the preferable base rubber of the rubber composition include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred that the polybutadiene is a principal component. Specifically, the proportion of the polybutadiene to the entire base rubber is preferably equal to or greater than 50% by weight and particularly preferably equal to or greater than 80% by weight. A polybutadiene in which the proportion of cis-1,4 bonds is equal to or greater than 80% is particularly preferred.

The rubber composition of the envelope layer 14 preferably includes a co-crosslinking agent. Preferable co-crosslinking agents in light of resilience performance are monovalent or bivalent metal salts of an α,β-unsaturated carboxylic acid having 2 to 8 carbon atoms. Examples of preferable co-crosslinking agents include zinc acrylate, magnesium acrylate, zinc methacrylate, and magnesium methacrylate. In light of resilience performance, zinc acrylate and zinc methacrylate are particularly preferred.

The rubber composition may include a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

In light of resilience performance of the golf ball 2, the amount of the co-crosslinking agent per 100 parts by weight of the base rubber is preferably equal to or greater than 10 parts by weight and particularly preferably equal to or greater than 15 parts by weight. In light of soft feel at impact, the amount is preferably equal to or less than 50 parts by weight and particularly preferably equal to or less than 45 parts by weight.

Preferably, the rubber composition of the envelope layer 14 includes an organic peroxide together with the co-crosslinking agent. The organic peroxide serves as a crosslinking initiator. The organic peroxide contributes to the resilience performance of the golf ball 2. The envelope layer 14 can include the organic peroxide mentioned above for the center 12.

In light of resilience performance of the golf ball 2, the amount of the organic peroxide per 100 parts by weight of the base rubber is preferably equal to or greater than 0.1 parts by weight, more preferably equal to or greater than 0.3 parts by weight, and particularly preferably equal to or greater than 0.5 parts by weight. In light of soft feel at impact, the amount is preferably equal to or less than 3.0 parts by weight, more preferably equal to or less than 2.8 parts by weight, and particularly preferably equal to or less than 2.5 parts by weight.

Preferably, the rubber composition of the envelope layer 14 includes an organic sulfur compound. The envelope layer 14 can include the organic sulfur compound mentioned above for the center 12. Examples of other organic sulfur compounds suitable for the envelope layer 14 include 2-thionaphthol.

In light of resilience performance of the golf ball 2, the amount of the organic sulfur compound per 100 parts by weight of the base rubber is preferably equal to or greater than 0.1 parts by weight and particularly preferably equal to or greater than 0.2 parts by weight. In light of soft feel at impact, the amount is preferably equal to or less than 1.5 parts by weight, more preferably equal to or less than 1.0 parts by weight, and particularly preferably equal to or less than 0.8 parts by weight.

For the purpose of adjusting specific gravity and the like, a filler may be included in the envelope layer 14. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the envelope layer 14 is accomplished. A particularly preferable filler is zinc oxide. Zinc oxide serves not only as a specific gravity adjuster but also as a crosslinking activator. According to need, various additives such as sulfur, an anti-aging agent, a coloring agent, a plasticizer, a dispersant, and the like are included in the rubber composition of the envelope layer 14 in an adequate amount.

Crosslinked rubber powder or synthetic resin powder may also be included in the envelope layer 14.

The envelope layer 14 has a thickness of preferably equal to or greater than 7 mm but equal to or less than 16 mm. The temperature for crosslinking the envelope layer 14 is equal to or higher than 140° C. but equal to or lower than 180° C. The time period for crosslinking the envelope layer 14 is equal to or longer than 10 minutes but equal to or shorter than 60 minutes. The envelope layer 14 may include two or more layers.

The core 4 has a surface hardness Hs of preferably equal to or greater than 35 but equal to or less than 70. The core 4 having a surface hardness Hs of equal to or greater than 35 suppresses spin in a shot with a driver. In this respect, the surface hardness Hs is more preferably equal to or greater than 40 and particularly preferably equal to or greater than 45. The golf ball 2 that includes the core 4 having a surface hardness Hs of equal to or less than 70 is excellent in durability. In this respect, the surface hardness Hs is more preferably equal to or less than 65 and particularly preferably equal to or less than 60. The surface hardness Hs is measured by pressing a Shore D type hardness scale against the surface of the core 4 from which the mid layer 6 and the cover 8 have been removed. For the measurement, an automated rubber-hardness measurement machine (trade name "P1", manufactured by Kobunshi Keiki Co., Ltd.), to which this hardness scale is mounted, is used.

The core 4 has a diameter of preferably equal to or greater than 38.0 mm. The golf ball 2 that includes the core 4 having a diameter of equal to or greater than 38.0 mm is excellent in resilience performance. In this respect, the diameter is more preferably equal to or greater than 38.5 mm, and particularly preferably equal to or greater than 39.5 mm. From the standpoint that the mid layer 6 and the cover 8 can have a sufficient thickness, the diameter is preferably equal to or less than 40.0 mm.

In the core 4, a difference (Hs−Ho) between the surface hardness Hs and the central hardness Ho is preferably equal to or greater than 15 but equal to or less than 35. The core 4 has a weight of preferably equal to or greater than 30 g but equal to or less than 41 g. The core 4 may have a single-layer structure.

The mid layer 6 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferred. Ionomer resins are highly elastic. As described later, the cover 8 of the golf ball 2 is thin. When the golf ball 2 is hit, the mid layer 6 is significantly deformed due to the thinness of the cover 8. Therefore, the mid layer 6 greatly influences resilience performance. The golf ball 2 that has the mid layer 6 including an ionomer resin is excellent in resilience performance.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 70% by weight, and particularly preferably equal to or greater than 85% by weight.

Examples of preferable ionomer resins include binary copolymers formed with an α-olefin and an α,β-unsaturated carboxylic acid having 3 to 8 carbon atoms. A preferable binary copolymer contains 80% by weight or more but 90% by weight or less of an α-olefin, and 10% by weight or more but 20% by weight or less of an α,β-unsaturated carboxylic acid. The binary copolymer is excellent in resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer contains 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer is excellent in resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid. Another particularly preferable ionomer resin is a copolymer formed with ethylene and methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7329", and "Himilan AM7337", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination.

The resin composition of the mid layer 6 may include a styrene block-containing thermoplastic elastomer. The styrene block-containing thermoplastic elastomer includes a polystyrene block as a hard segment, and a soft segment. A typical soft segment is a diene block. Examples of compounds for the diene block include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include an alloy of an olefin and one or more members selected from the group consisting of SBS, SIS, SIBS, SEBS, SEPS, and SEEPS. The olefin component in the alloy is presumed to contribute to improvement of compatibility with another base polymer. Use of this alloy improves the resilience performance of the golf ball 2. An olefin having 2 to 10 carbon atoms is preferably used. Examples of suitable olefins include ethylene, propylene, butene, and pentene. Ethylene and propylene are particularly preferred.

Specific examples of polymer alloys include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N", and "Rabalon SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "Septon HG-252" manufactured by Kuraray Co., Ltd.

For the purpose of adjusting specific gravity and the like, a filler may be included in the resin composition of the mid layer 6. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the mid layer 6 is accomplished. A coloring agent, crosslinked rubber powder, or synthetic resin powder may also be included in the mid layer 6.

The mid layer 6 has a hardness Hm of preferably equal to or greater than 55. The mid layer 6 having a hardness Hm of equal to or greater than 55 suppresses spin when the golf ball 2 is hit with a long iron. In this respect, the hardness Hm is more preferably equal to or greater than 60, and particularly preferably equal to or greater than 63. The hardness Hm is preferably equal to or less than 75.

The hardness Hm of the mid layer 6 and a hardness Hc of the cover 8 are measured according to the standards of "ASTM-D 2240-68". For the measurement, an automated rubber-hardness measurement machine (trade name "P1", manufactured by Kobunshi Keiki Co., Ltd.), to which a Shore D type hardness scale is mounted, is used. For the measurement, a sheet that is formed by hot press, is formed from the same material as that of the mid layer 6 (or the cover 8), and has a thickness of approximately 2 mm is used. Prior to the measurement, a sheet is kept at 23° C. for two weeks. At the measurement, three sheets are stacked.

The mid layer 6 has a thickness Tm of preferably equal to or less than 2.0 mm. When the golf ball 2 that includes the mid layer 6 having a thickness Tm of 2.0 mm or less is hit with a short iron, a sufficient spin rate is obtained. Furthermore, when the golf ball 2 is hit with a short iron, variations in spin rates are small. In this respect, the thickness Tm is more preferably equal to or less than 1.8 mm, and particularly preferably equal to or less than 1.6 mm. From the standpoint that the mid layer 6 contributes to resilience performance, the thickness Tm is equal to or greater than 0.8 mm. The thickness Tm of the mid layer 6 is measured at a position directly below the land 18.

The cover 8 is formed from a resin composition. Examples of the base resin of the resin composition include polyurethanes, polyamide elastomers, styrene block-containing thermoplastic elastomers, polyester elastomers, polyolefin elastomers, and ionomer resins.

A preferable base polymer is a polyurethane. The resin composition may include a thermoplastic polyurethane, or may include a thermosetting polyurethane. In light of productivity, the thermoplastic polyurethane is preferable. The thermoplastic polyurethane includes a polyurethane component as a hard segment, and a polyester component or a polyether component as a soft segment. The thermoplastic polyurethane is flexible. The cover 8 in which the polyurethane is used has excellent scuff resistance. When a thermoplastic polyurethane and another resin are used in combination for the cover 8, the proportion of the thermoplastic polyurethane to the entire base resin is preferably equal to or greater than 50% by weight, more preferably equal to or greater than 60% by weight, and particularly preferably equal to or greater than 70% by weight.

The thermoplastic polyurethane has a urethane bond within the molecule. The urethane bond can be formed by reacting a polyol with a polyisocyanate. The polyol, as a material for the urethane bond, has a plurality of hydroxyl groups. Low-molecular-weight polyols and high-molecular-weight polyols can be used.

Examples of low-molecular-weight polyols include diols, triols, tetraols, and hexaols. Specific examples of diols include ethylene glycol, diethylene glycol, triethylene glycol, 1,2-propanediol, 1,3-propanediol, 2-methyl-1,3-propanediol, dipropylene glycol, 1,2-butanediol, 1,3-butanediol, 1,4-butanediol, 2,3-butanediol, 2,3-dimethyl-2,3-butanediol, neopentyl glycol, pentanediol, hexanediol, heptanediol, octanediol, and 1,6-cyclohexanedimethylol. Aniline-based diols or bisphenol A-based diols may be used. Specific examples of triols include glycerin, trimethylol propane, and hexanetriol. Specific examples of tetraols include pentaerythritol and sorbitol.

Examples of high-molecular-weight polyols include polyether polyols such as polyoxyethylene glycol (PEG), polyoxypropylene glycol (PPG), and polytetramethylene ether glycol (PTMG); condensed polyester polyols such as polyethylene adipate (PEA), polybutylene adipate (PBA), and polyhexamethylene adipate (PHMA); lactone polyester polyols such as poly-s-caprolactone (PCL); polycarbonate polyols such as polyhexamethylene carbonate; and acrylic polyols. Two or more polyols may be used in combination. In light of feel at impact of the golf ball 2, the high-molecular-weight polyol has a number average molecular weight of preferably equal to or greater than 400 and more preferably equal to or greater than 1000. The number average molecular weight is preferably equal to or less than 10000.

Examples of polyisocyanates, as a material for the urethane bond, include aromatic diisocyanates, alicyclic diisocyanates, and aliphatic diisocyanates. Two or more types of diisocyanates may be used in combination.

Examples of aromatic diisocyanates include 2,4-toluene diisocyanate, 2,6-toluene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and paraphenylene diisocyanate (PPDI). One example of aliphatic diisocyanates is hexamethylene diisocyanate (HDI). Examples of alicyclic diisocyanates include 4,4'-dicyclohexylmethane diisocyanate ($H_{12}MDI$), 1,3-bis (isocyanatemethyl)cyclohexane ($H_6XDI$), isophorone diisocyanate (IPDI), and trans-1,4-cyclohexane diisocyanate (CHDI). 4,4'-dicyclohexylmethane diisocyanate is preferable.

Specific examples of the thermoplastic polyurethane include trade names "Elastollan XNY80A", "Elastollan XNY82A", "Elastollan XNY85A", "Elastollan XNY90A", "Elastollan XNY95A", "Elastollan XNY97A", "Elastollan XNY585", and "Elastollan XKP016N", manufactured by BASF Japan Ltd.; and trade names "RESAMINE P4585LS" and "RESAMINE PS62490", manufactured by Dainichiseika Color & Chemicals Mfg. Co., Ltd.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the resin composition of the cover 8 in an adequate amount.

The golf ball 2 satisfies the following mathematical formula (1).

$$Hc \leq 49 \quad (1)$$

In other words, the cover 8 has a hardness Hc of equal to or less than 49. The cover 8 having a hardness Hc of equal to or less than 49 enhances a spin rate in a shot with a short iron. Furthermore, the cover 8 also contributes to spin stability in a shot with a short iron. In this respect, the hardness Hc is more preferably equal to or less than 45, and particularly preferably equal to or less than 40. The hardness Hc is preferably equal to or greater than 10.

The cover 8 has a thickness To of preferably equal to or less than 0.8 mm. The cover 8 having a thickness To of equal to or less than 0.8 mm suppresses spin in a shot with a long iron. When the golf ball 2 having the cover 8 is hit with a long iron, the flight distance is large. In this respect, the thickness Tc is more preferably equal to or less than 0.6 mm, and particularly preferably equal to or less than 0.5 mm. In light of ease of forming the cover 8, the thickness Tc is preferably equal to or greater than 0.1 mm. The thickness Tc of the cover 8 is measured at a position directly below the land 18.

The golf ball 2 may include a reinforcing layer between the mid layer 6 and the cover 8. The reinforcing layer firmly adheres to the mid layer 6 and also to the cover 8. The reinforcing layer suppresses separation of the cover 8 from the mid layer 6. The reinforcing layer is formed from a resin composition. Examples of the base polymer of the reinforcing layer include two-component curing type epoxy resins and two-component curing type urethane resins.

The paint layer 10 is formed from a resin composition. The base resin of the resin composition is a two-component curing type polyurethane. The two-component curing type polyurethane is obtained by a reaction of a base material and a curing agent. A two-component curing type polyurethane obtained by a reaction of: a base material containing a polyol component; and a curing agent containing a polyisocyanate (including a polyisocyanate derivative), is preferred.

The paint layer 10 has a thickness Tp of preferably equal to or less than 0.05 mm. The paint layer 10 having a thickness Tp of equal to or less than 0.05 mm does not hamper turbulization caused by the dimples 16. In this respect, the thickness Tp is more preferably equal to or less than 0.04 mm, and particularly preferably equal to less than 0.03 mm. In light of durability of the paint layer 10, the thickness Tp is preferably equal to or greater than 0.005 mm.

In light of feel at impact, the golf ball 2 has an amount of compressive deformation CD of preferably equal to or greater than 1.5 mm, more preferably equal to or greater than 1.8 mm, and particularly preferably equal to or greater than 2.0 mm. In light of resilience performance, the amount of compressive deformation CD is preferably equal to or less than 3.2 mm, more preferably equal to or less than 3.0 mm, and particularly preferably equal to or less than 2.8 mm.

For measurement of the amount of compressive deformation CD, a YAMADA type compression tester is used. In the tester, the golf ball 2 is placed on a hard plate made of metal. Next, a cylinder made of metal gradually descends toward the golf ball 2. The golf ball 2, squeezed between the bottom face of the cylinder and the hard plate, becomes deformed. A migration distance of the cylinder, starting from the state in which an initial load of 98 N is applied to the golf ball 2 up to the state in which a final load of 1274 N is applied thereto, is measured. A moving speed of the cylinder until the initial load is applied is 0.83 mm/s. A moving speed of the cylinder after the initial load is applied until the final load is applied is 1.67 mm/s. The atmospheric temperature at the measurement is 23° C. Prior to the measurement, the golf ball 2 is kept in a thermostat bath at 23° C. for 24 hours or longer.

The golf ball 2 satisfies the following mathematical formula (2).

$$Hm - Hc \geq 15 \quad (2)$$

In the golf ball 2, the mid layer 6 is relatively hard, and the cover 8 is relatively flexible. When the golf ball 2 is hit with a short iron, the cover 8 is sandwiched between a club face and the mid layer 6. The golf ball 2 is less likely to slip on the club face. The golf ball 2 has an excellent controllability in an approach shot. In light of controllability, the difference (Hm−Hc) is more preferably equal to or greater than 18, and particularly preferably equal to or greater than 20. The difference (Hm−Hc) is preferably equal to or less than 50.

The golf ball 2 satisfies the following mathematical formula (3).

$$Hm - Hb \leq 2 \quad (3)$$

In the mathematical formula (3), Hb represents a surface hardness of the golf ball 2. The surface hardness Hb is measured by pressing a Shore D type hardness scale against the surface of the golf ball 2 (i.e., the surface of the paint layer 10). For the measurement, an automated rubber-hardness measurement machine (trade name "P1", manufactured by Kobunshi Keiki Co., Ltd.), to which this hardness scale is mounted, is used.

In the golf ball 2 which satisfies the mathematical formula (3), the influence of the cover 8 on the hardness Hb is small. In other words, the cover 8 is thin. When the golf ball 2 is hit with a driver, spin is suppressed although the cover 8 is flexible. The golf ball 2 has an excellent flight performance in a shot with a driver. In light of flight performance, the difference (Hm−Hb) is particularly preferably equal to or less than 1. The difference is preferably equal to or greater than 0.

The hardness Hb is preferably equal to or greater than 50 but equal to or less than 75, and particularly preferably equal to or greater than 55 but equal to or less than 70.

Preferably, the golf ball 2 satisfies the following mathematical formula (4).

$$0.6 \leq (Hm - Ho)/Hc \leq 1.5 \quad (4)$$

In the golf ball 2, the difference (Hm−Ho) is relatively large, and the hardness Hc is relatively small. In the golf ball 2 having a large difference (Hm−Ho), spin in a shot with a driver is suppressed. The golf ball 2 has an excellent flight performance in a shot with a driver. The golf ball 2 having a small hardness Hc has an excellent controllability in an approach shot. The golf ball 2 satisfying the mathematical formula (4) is excellent in both flight performance and controllability. In this respect, the ratio ((Hm−Ho)/Hc) is more preferably equal to or greater than 0.8, and particularly preferably equal to or greater than 1.0.

Figure 2:
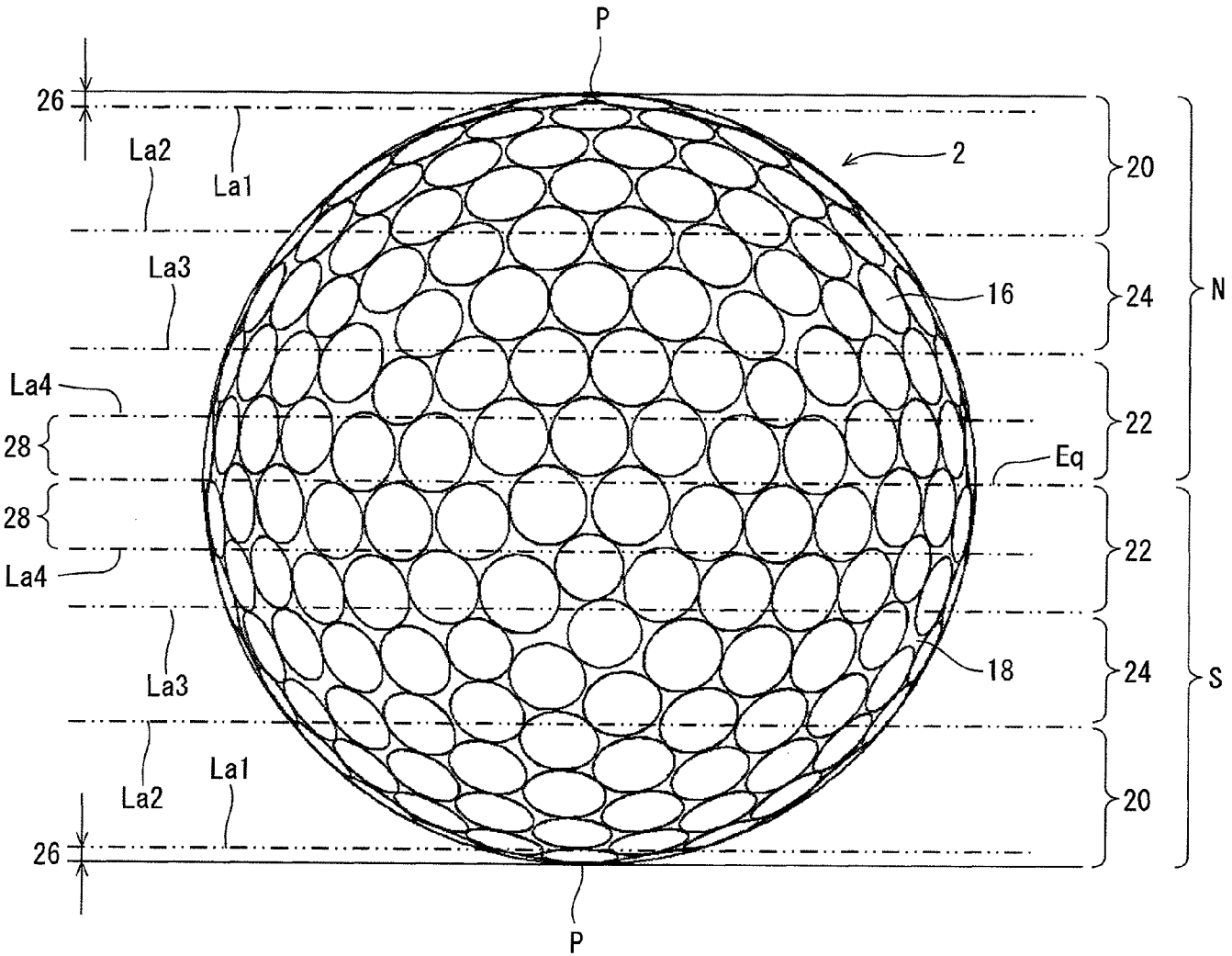
FIG. 2 is an enlarged front view of the golf ball in FIG. 1.

FIG. 2 is an enlarged front view of the golf ball 2 in FIG. 1. FIG. 2 depicts two poles P, two first latitude lines La1, two second latitude lines La2, two third latitude lines La3, two fourth latitude lines La4 and an equator Eq. A mold of the golf ball 2 includes upper and lower mold halves. One of the poles P coincides with the deepest point of the upper mold half. The other pole P coincides with the deepest point of the lower mold half. Each pole P has a latitude of 90°. The equator Eq has a latitude of 0°. The latitude of each first latitude line La1 is greater than the latitude of each second latitude line La2. The latitude of each second latitude line La2 is greater than the latitude of each third latitude line La3. The latitude of each third latitude line La3 is greater than the latitude of each fourth latitude line La4. The latitude of each fourth latitude line La4 is greater than the latitude of the equator Eq (0°). The first latitude line La1 has a latitude of 75°. The second latitude line La2 has a latitude of 40°. The third latitude line La3 has a latitude of 20°. The fourth latitude line La4 has a latitude of 10°.

The golf ball 2 has a northern hemisphere N above the equator Eq and a southern hemisphere S below the equator Eq. The dimple pattern of the southern hemisphere S and the dimple pattern of the northern hemisphere N are rotationally symmetrical to each other. Each of the northern hemisphere N and the southern hemisphere S has a high-latitude region 20, a low-latitude region 22, and a mid-latitude region 24. The second latitude line La2 is the boundary line between the high-latitude region 20 and the mid-latitude region 24. The third latitude line La3 is the boundary line between the mid-latitude region 24 and the low-latitude region 22. The high-latitude region 20 is surrounded by the second latitude line La2. The low-latitude region 22 is positioned between the third latitude line La3 and the equator Eq. The mid-latitude region 24 is positioned between the second latitude line La2 and the third latitude line La3. In other words, the mid-latitude region 24 is positioned between the high-latitude region 20 and the low-latitude region 22. The high-latitude region 20 has a latitude range of equal to or greater than 40° but equal to or less than 90°. The mid-latitude region 24 has a latitude range of equal to or greater than 20° but less than 40°. The low-latitude region 22 has a latitude range of equal to or greater than 0° but less than 20°.

The high-latitude region 20 includes a pole vicinity region 26. The pole vicinity region 26 is surrounded by the first latitude line La1. The pole vicinity region 26 has a latitude range of equal to or greater than 75° but equal to or less than 90°.

The low-latitude region 22 includes an equator vicinity region 28. The equator vicinity region 28 is sandwiched between the fourth latitude line La4 and the equator Eq. The equator vicinity region 28 has a latitude range of equal to or greater than 0° but less than 10°.

As is clear from FIG. 2, each of the dimples 16 has a circular plane shape. The golf ball 2 has dimples 16 belonging to the high-latitude region 20, dimples 16 belonging to the mid-latitude region 24, and dimples 16 belonging to the low-latitude region 22. Some of the dimples 16 that belong to the high-latitude region 20 also belong to the pole vicinity region 26. Some of the dimples 16 that belong to the low-latitude region 22 also belong to the equator vicinity region 28.

For each dimple 16 that intersects any one of the latitude lines, the region to which the dimple 16 belongs is determined based on the position of the center of the dimple 16. For example, the dimple 16 that intersects the first latitude line La1 and whose center is located in the pole vicinity region 26 belongs to the pole vicinity region 26. The dimple 16 that intersects the second latitude line La2 and whose center is located in the high-latitude region 20 belongs to the high-latitude region 20. The dimple 16 that intersects the second latitude line La2 and whose center is located in the mid-latitude region 24 belongs to the mid-latitude region 24. The dimple 16 that intersects the third latitude line La3 and whose center is located in the mid-latitude region 24 belongs to the mid-latitude region 24. The dimple 16 that intersects the third latitude line La3 and whose center is located in the low-latitude region 22 belongs to the low-latitude region 22. The dimple 16 that intersects the fourth latitude line La4 and whose center is located in the equator vicinity region 28 belongs to the equator vicinity region 28. The center of the dimple 16 is a point at which a straight line passing through the deepest part of the dimple 16 and the center of the golf ball 2 intersects a phantom sphere Sp (See FIG. 8).

Figure 3:
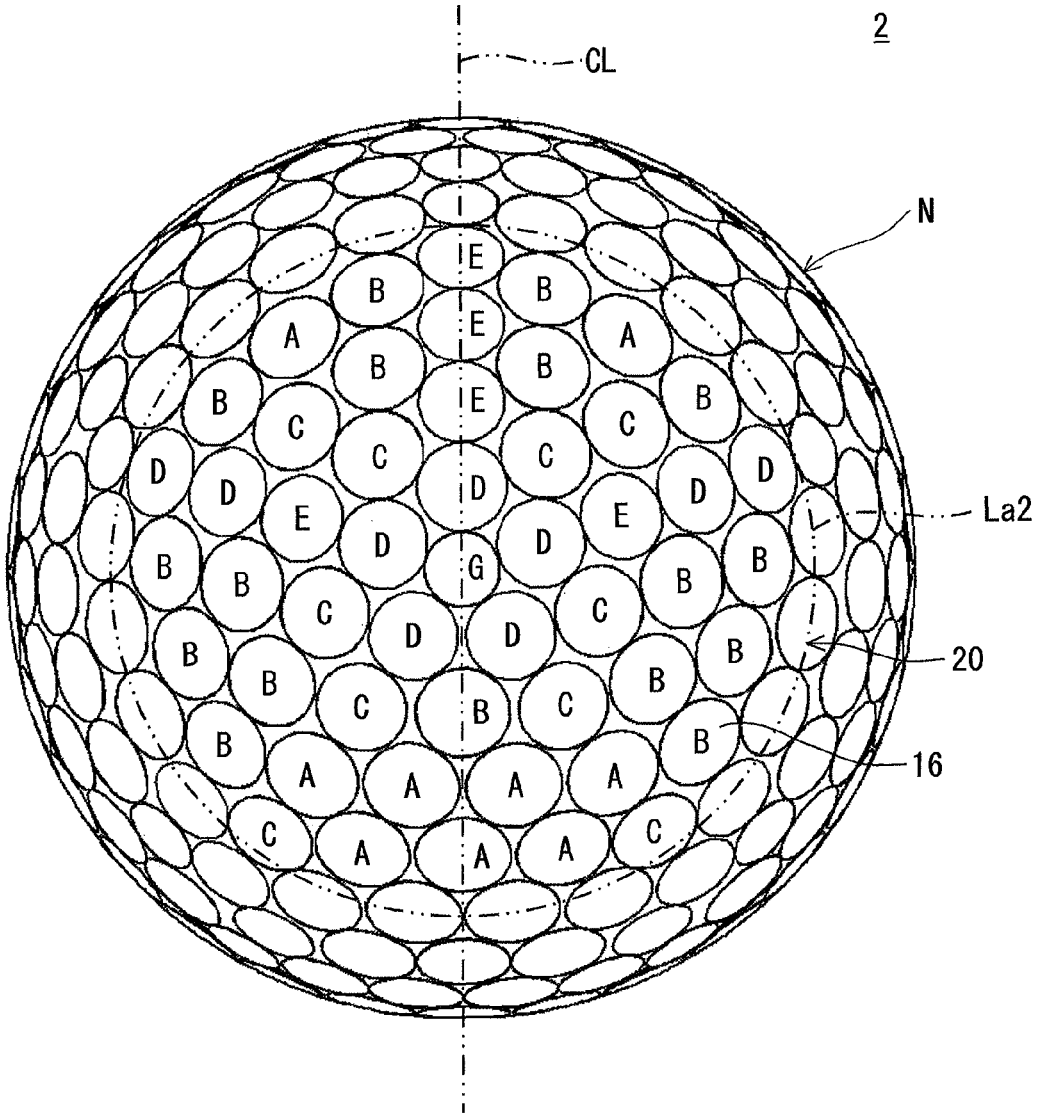
FIG. 3 is a plan view of the golf ball in FIG. 2.

FIG. 3 is a plan view of the golf ball 2 in FIG. 2. FIG. 3 shows the northern hemisphere N. A dimple pattern of the northern hemisphere N in the plan view is symmetrical about a center line CL. Therefore, a three-dimensional dimple pattern is mirror symmetrical about a plane that includes the center line CL and passes through the center of the golf ball 2. Another plane that can divide the dimple pattern so that divided dimple patterns are mirror symmetrical to each other does not exist. The number N2 of planes that can divide the dimple pattern so that divided dimple patterns are mirror symmetrical to each other is one. Also in the southern hemisphere S, the number N2 of planes that can divide the dimple pattern so that divided dimple patterns are mirror symmetrical to each other is one.

FIG. 3 shows the second latitude line La2. A zone surrounded by the second latitude line La2 is the high-latitude region 20. For the high-latitude region 20, types of the dimples 16 are indicated by the reference characters A, B, C, D, E and G. Each of the dimples 16 has a circular contour. The high-latitude region 20 includes: dimples A having a diameter of 4.60 mm; dimples B having a diameter of 4.50 mm; dimples C having a diameter of 4.40 mm; dimples D having a diameter of 4.30 mm; dimples E having a diameter of 4.15 mm; and a dimple G having a diameter of 3.60 mm.

When the dimple pattern of the high-latitude region 20 is rotated about a straight line passing though the both poles P (See FIG. 2), the rotated dimple pattern does not agree with the dimple pattern before the rotation as long as the rotation angle is greater than 0° but less than 360°. In other words, the dimple pattern of the high-latitude region 20 is not rotationally symmetrical.

Figure 4:
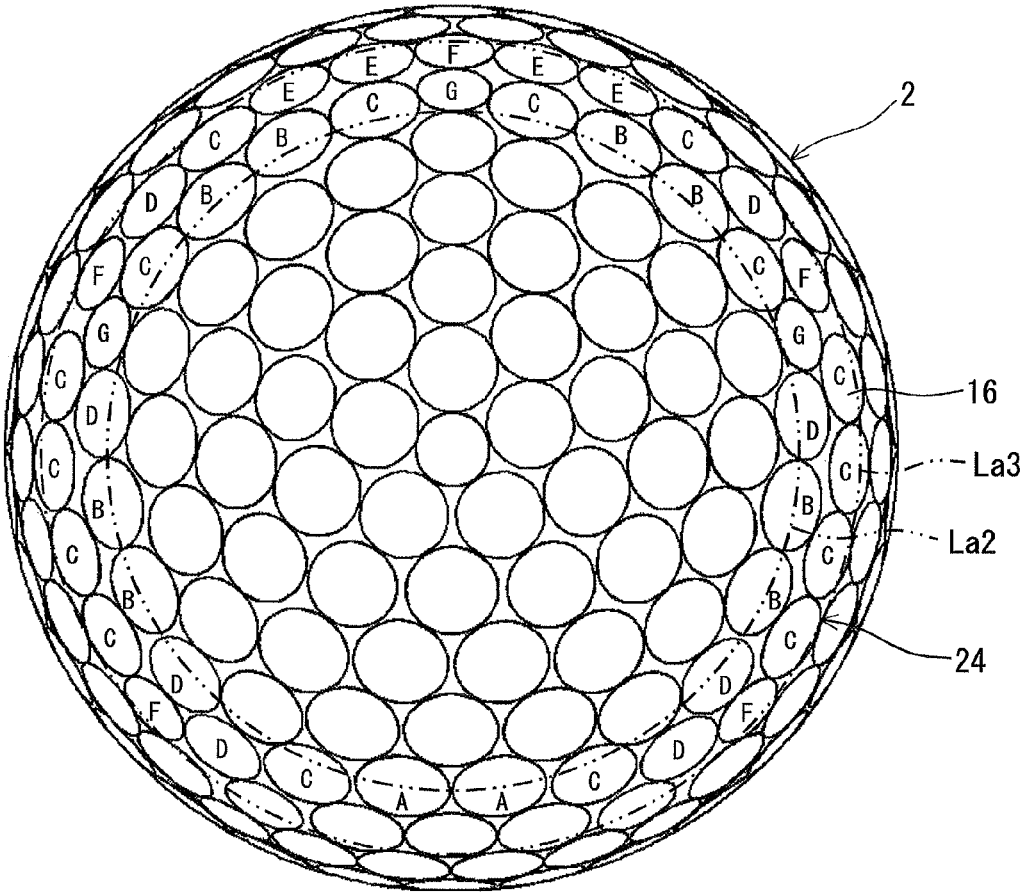
FIG. 4 is a plan view of the golf ball in FIG. 2.

FIG. 4 is a plan view of the golf ball 2 in FIG. 2. FIG. 4 shows the second latitude line La2 and the third latitude line La3. A zone sandwiched between the second latitude line La2 and the third latitude line La3 is the mid-latitude region 24. For the mid-latitude region 24, types of the dimples 16 are indicated by the reference characters B, C, D, E, F and G. Each of the dimples 16 has a circular contour. The mid-latitude region 24 includes: dimples B having a diameter of 4.50 mm; dimples C having a diameter of 4.40 mm; dimples D having a diameter of 4.30 mm; dimples E having a diameter of 4.15 mm; dimples F having a diameter of 3.85 mm; and dimples G having a diameter of 3.60 mm.

When the dimple pattern of the mid-latitude region 24 is rotated about the straight line passing though the both poles P (See FIG. 2), the rotated dimple pattern does not agree with the dimple pattern before the rotation as long as the rotation angle is greater than 0° but less than 360°. In other words, the dimple pattern of the mid-latitude region 24 is not rotationally symmetrical. The dimple pattern of the mid-latitude region 24 may be rotationally symmetrical. In a rotatinally-symmetrical dimple pattern, at a rotation angle of greater than 0° but less than 360°, a rotated dimple pattern agrees with the dimple pattern before the rotation.

Figure 5:
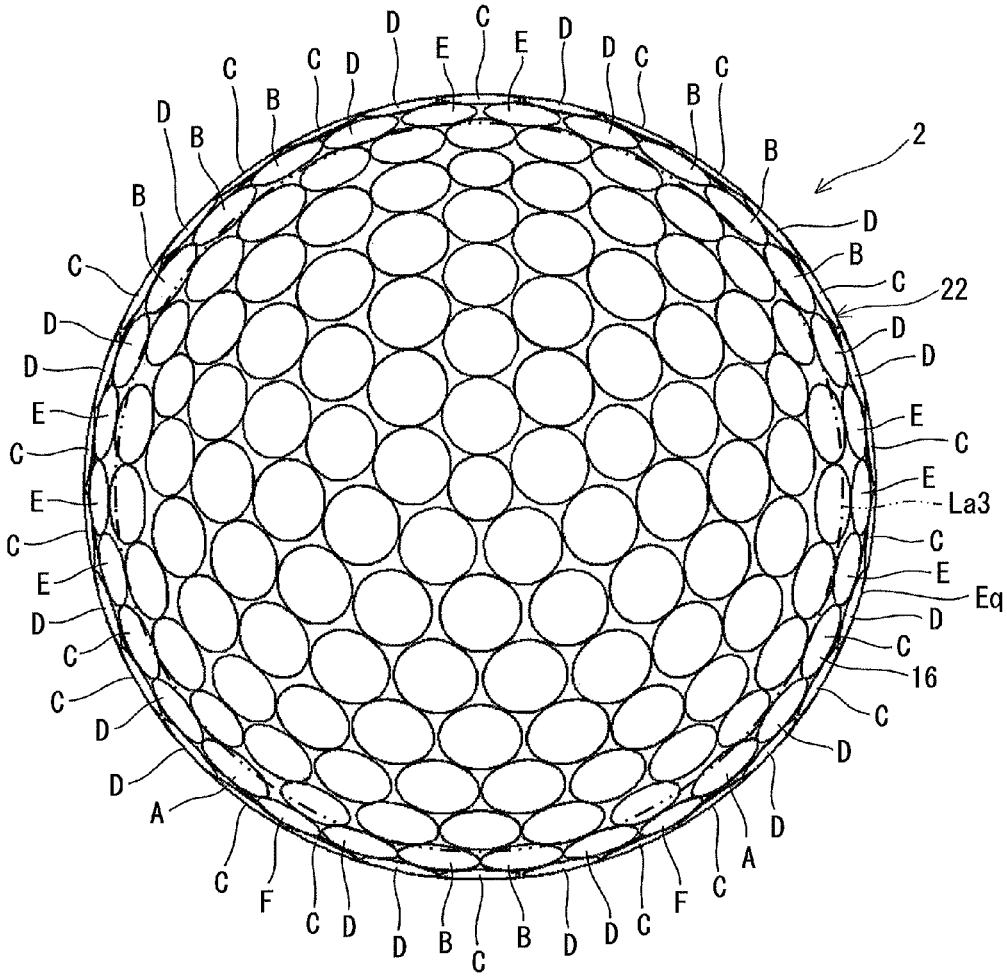
FIG. 5 is a plan view of the golf ball in FIG. 2.

FIG. 5 is a plan view of the golf ball 2 in FIG. 2. FIG. 5 shows the third latitude line La3. A zone sandwiched between the third latitude line La3 and the equator Eq (See FIG. 2) is the low-latitude region 22. For the low-latitude region 22, types of the dimples 16 are indicated by the reference characters A, B, C, D, E and F. Each of the dimples 16 has a circular contour. The low-latitude region 22 includes: dimples A having a diameter of 4.60 mm; dimples B having a diameter of 4.50 mm; dimples C having a diameter of 4.40 mm; dimples D having a diameter of 4.30 mm; dimples E having a diameter of 4.15 mm; and dimples F having a diameter of 3.85 mm.

When the dimple pattern of the low-latitude region 22 is rotated about the straight line passing though the both poles P (See FIG. 2), the rotated dimple pattern does not agree with the dimple pattern before the rotation as long as the rotation angle is greater than 0° but less than 360°. In other words, the dimple pattern of the low-latitude region 22 is not rotationally symmetrical.

In the golf ball 2, as already mentioned, the dimple pattern of the high-latitude region 20 is not rotationally symmetrical, and the dimple pattern of the low-latitude region 22 is not rotationally symmetrical, either. The dimple pattern of the golf ball 2 is not monotonous. The characteristic of the dimple pattern is similar to the characteristic of the random pattern. The dimple pattern accelerates turbulization.

As already mentioned, the dimple pattern of the golf ball 2 can be divided so that divided dimple patterns are mirror symmetrical to each other by a plane including the center line CL. In other words, the dimple pattern has a regularity as compared with a complete random pattern. Therefore, the dimple pattern has a great occupation ratio (to be detailed later). The number of planes that can divide a dimple pattern of the hemisphere so that divided dimple patterns are mirror symmetry to each other is as few as one. Therefore, the dimple pattern in not monotonous.

When the golf ball 2 having a dimple pattern that is not monotonous and has great occupation ratio is hit with an iron, an excessive lift force is not generated. The golf ball 2 is excellent in flight distance performance and flight distance stability in a shot with an iron.

As already mentioned, in the golf ball 2, the dimple pattern of the mid-latitude region 24 is not rotationally symmetrical, either. The golf ball 2 is extremely excellent in flight performance.

Figure 6:
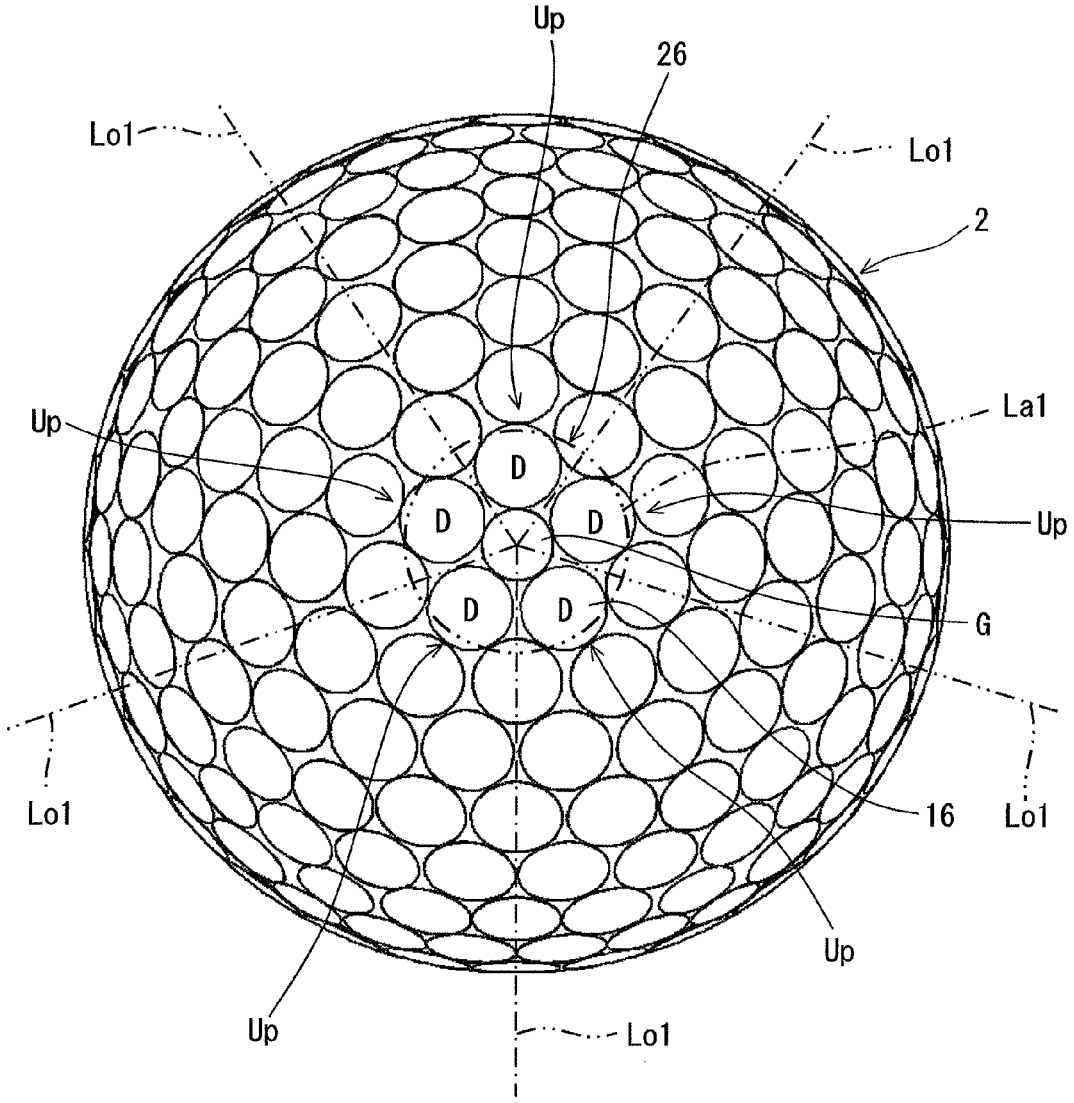
FIG. 6 is a plan view of the golf ball in FIG. 2.

FIG. 6 is a plan view of the golf ball 2 in FIG. 2. FIG. 6 shows the first latitude line La1 and five first longitude lines Lo1. In FIG. 6, a zone surrounded by the first latitude line La1 is the pole vicinity region 26. The pole vicinity region 26 can be divided into five units Up. Each of the units Up has a shape of a spherical triangle. The contour of the unit Up consists of the first latitude line La1 and two first longitude lines Lo1.

The dimple patterns of the five units Up are 72° rotationally symmetrical to each other. In other words, when the dimple pattern of one unit Up is rotated 72° in the latitude direction about the straight line passing through the both poles P (See FIG. 2), it substantially agrees with the dimple pattern of the adjacent unit Up. The rotationally symmetrical angle of the dimple pattern is 72°.

The golf ball 2 having a dimple pattern in the pole vicinity region 26 of rotationally symmetry is excellent in flight distance stability. The number of units of the pole vicinity region 26 is preferably 3 or greater but 6 or less. The pole vicinity region 26 may have a dimple pattern which is not rotationally symmetrical.

Figure 7:
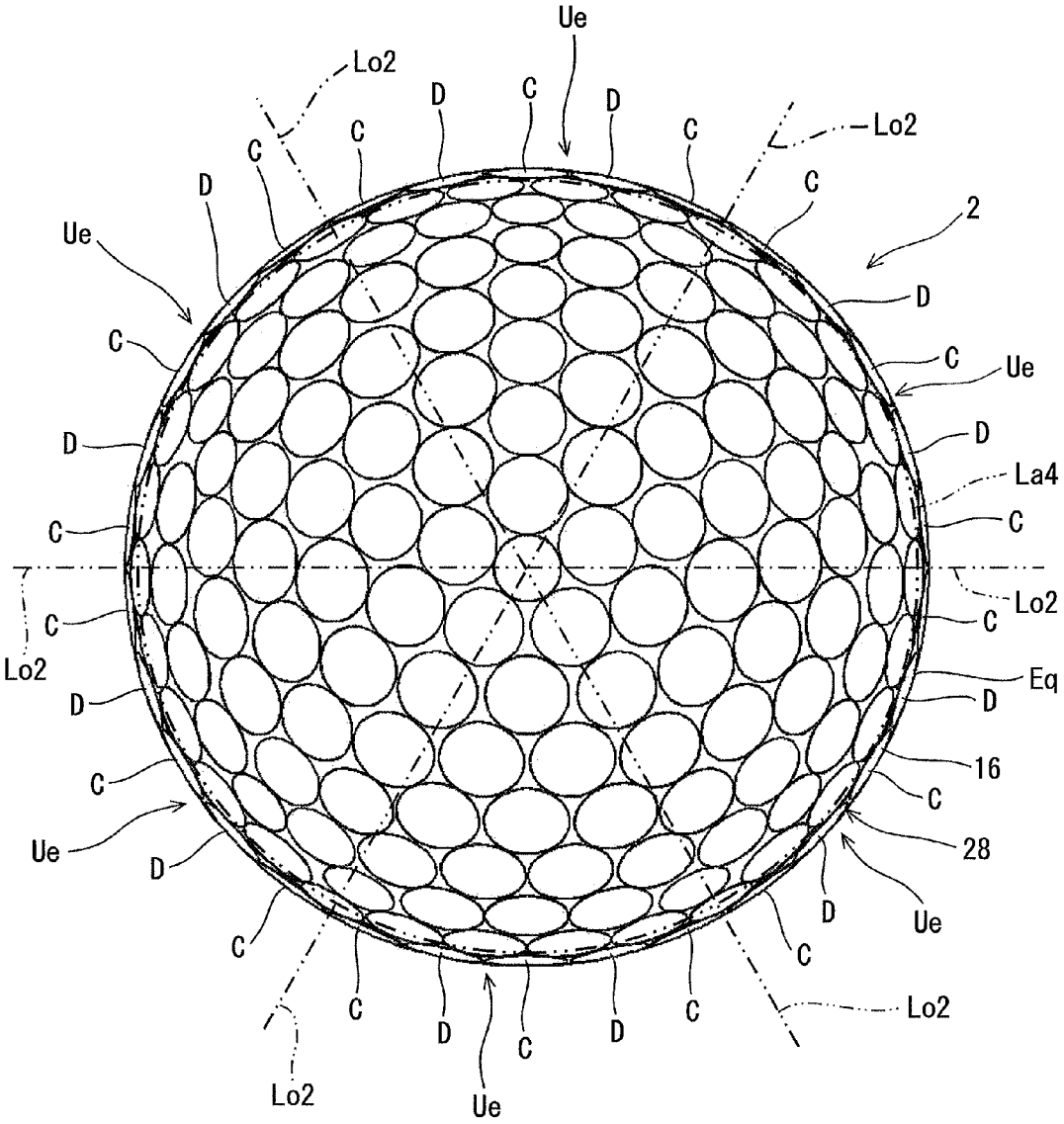
FIG. 7 is a plan view of the golf ball in FIG. 2.

FIG. 7 is a plan view of the golf ball 2 in FIG. 2. FIG. 7 shows the fourth latitude line La4 and six second longitude lines Lo2. In FIG. 7, a zone sandwiched between the fourth latitude line La4 and the equator Eq (See FIG. 2) is the equator vicinity region 28. The equator vicinity region 28 is divided into six units Ue. Each of the units Ue has a shape of a spherical trapezoid. The contour of the unit Ue consists of the fourth latitude line La4, two second longitude lines Lo2, and the equator Eq.

The dimple patterns of the six units Ue are 60° rotationally symmetrical to each other. In other words, when the dimple pattern of one unit Ue is rotated 60° in the latitude direction about the straight line passing through the both poles P (See FIG. 2), it substantially agrees with the dimple pattern of the adjacent unit Ue. The rotationally symmetrical angle of the dimple pattern is 60°.

The dimple pattern of the equator vicinity region 28 can also be divided into three units. In this case, the dimple pattern of each unit is 120° rotationally symmetrical to each other. The dimple pattern of the equator vicinity region 28 can also be divided into two units. In this case, the dimple pattern of each unit is 180° rotationally symmetrical to each other. The dimple pattern of the equator vicinity region 28 has three rotationally symmetrical angles (i.e., 60°, 120° and 180°). A region having a plurality of rotationally symmetrical angles is divided into units Ue based on the smallest rotationally symmetrical angle (60° in this example).

The golf ball 2 having a dimple pattern in the equator vicinity region 28 of rotational symmetry is excellent in flight distance stability. The golf ball 2 having a dimple pattern in the equator vicinity region 28 of rotational symmetry is easy to produce. The number of units of the equator vicinity region 28 is preferably 3 or greater but 6 or less. The equator vicinity region 28 may have a dimple pattern which is not rotationally symmetrical.

A great circle that exists on the surface of the golf ball 2 and that does not intersect any dimple 16 is referred to as a great circle path. The great circle path does not exist on the golf ball 2. The number N3 of the great circle paths is zero. In the golf ball 2, the flight distance does not have much dependence on the rotation axis of backspin. The golf ball 2 is excellent in flight distance stability.

Figure 8:
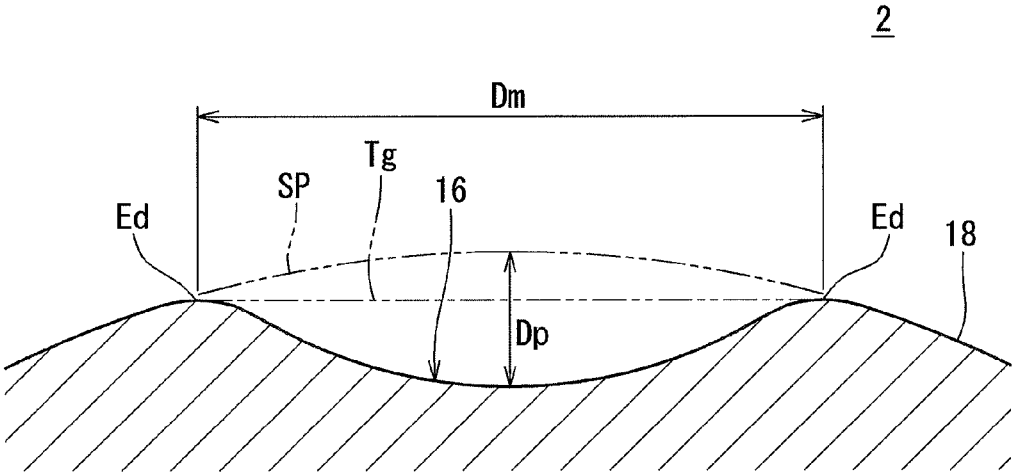
FIG. 8 is a schematic cross-sectional view of a portion of the golf ball in FIG. 1 in an enlarged manner.

FIG. 8 shows a cross section along a plane passing through the center of the dimple 16 and the center of the golf ball 2. In FIG. 8, the top-to-bottom direction is the depth direction of the dimple 16. In FIG. 8, a chain double-dashed line Sp represents a phantom sphere. The surface of the phantom sphere Sp is the surface of the golf ball 2 when it is postulated that no dimple 16 exists. The dimple 16 is recessed from the surface of the phantom sphere Sp. In the present embodiment, the cross-sectional shape of each dimple 16 is substantially a circular arc.

In FIG. 8, a double ended arrow Dm represents the diameter of the dimple 16. The diameter Dm is the distance between two tangent points Ed appearing on a tangent line Tg that is drawn tangent to the far opposite ends of the dimple 16. Each tangent point Ed is also the edge of the dimple 16. The edge Ed defines the contour of the dimple 16. In FIG. 8, a double ended arrow Dp represents the depth of the dimple 16. The depth Dp is the distance between the deepest part of the dimple 16 and the phantom sphere Sp.

The diameter Dm of each dimple 16 is preferably equal to or greater than 2.0 mm but equal to or less than 6.0 mm. The dimple 16 having a diameter Dm of 2.0 mm or greater contributes to turbulization. In this respect, the diameter Dm is more preferably equal to or greater than 2.5 mm and particularly preferably equal to or greater than 2.8 mm. The dimple 16 having a diameter Dm of 6.0 mm or less does not impair a fundamental feature of the golf ball 2 being substantially a sphere. In this respect, the diameter Dm is more preferably equal to or less than 5.5 mm and particularly preferably equal to or less than 5.0 mm.

In light of suppression of rising of the golf ball 2 during flight, the depth Dp of each dimple 16 is preferably equal to or greater than 0.10 mm, more preferably equal to or greater than 0.13 mm, and particularly preferably equal to or greater than 0.15 mm. In light of suppression of dropping of the golf ball 2 during flight, the depth Dp is preferably equal to or less than 0.60 mm, more preferably equal to or less than 0.55 mm, and particularly preferably equal to or less than 0.50 mm.

An area s of the dimple 16 is the area of a region surrounded by the contour line of the dimple 16 when the center of the golf ball 2 is viewed at infinity. In case of a circular dimple 16, the area S is calculated by the following formula.

$$S=(Dm/2)^2*\pi$$

In the golf ball 2 shown in FIGS. 2 to 7, the area of the dimple A is 16.62 $mm^2$; the area of the dimple B is 15.90 $mm^2$; the area of the dimple C is 15.21 $mm^2$; the area of the dimple D is 14.52 $mm^2$; the area of the dimple E is 13.53 $mm^2$; the area of the dimple F is 11.64 $mm^2$; and the area of the dimple G is 10.18 $mm^2$.

In the present invention, the ratio of the sum of the areas S of all the dimples 16 to the surface area of the phantom sphere Sp is referred to as an occupation ratio. From the standpoint that a sufficient dimple effect is achieved, the occupation ratio is preferably equal to or greater than 80%, more preferably equal to or greater than 82%, and particularly preferably equal to or greater than 84%. The occupation ratio is preferably equal to or less than 95%. In the golf ball 2 shown in FIGS. 2 to 7, the total area of the dimples 16 is 4812.0 $mm^2$. The surface area of the phantom sphere Sp of the golf ball 2 is 5728.0 $mm^2$, and thus the occupation ratio is 84.0%.

In light of achieving a sufficient occupation ratio, the total number N1 of the dimples 16 is preferably equal to or greater than 250, more preferably equal to or greater than 280, and particularly preferably equal to or greater than 300. From the standpoint that each dimple 16 can contribute to turbulization, the total number N1 is preferably equal to or less than 450, more preferably equal to or less than 400, and particularly preferably equal to or less than 380.

In the present invention, the term "dimple volume" means the volume of a part surrounded by the surface of the dimple 16 and a plane that includes the contour of the dimple 16. The total volume of all the dimples 16 of the golf ball 2 is preferably equal to or greater than 260 $mm^3$ but equal to or less than 360 $mm^3$, and particularly preferably equal to or greater than 290 $mm^3$ but equal to or less than 330 $mm^3$.

EXAMPLES

Example 1

A rubber composition was obtained by kneading 100 parts by weight of a high-cis polybutadiene (trade name "BR-730" manufactured by JSR Corporation), 35 parts by weight of magnesium oxide, 28 parts by weight of methacrylic acid and 0.9 parts by weight of dicumyl peroxide. This rubber composition was placed into a mold including upper and lower mold halves each having a hemispherical cavity, and heated at 150° C. for 20 minutes to obtain a center with a diameter of 15 mm.

A rubber composition was obtained by kneading 100 parts by weight of a high-cis polybutadiene (the aforementioned trade name "BR-730"), 35 parts by weight of zinc diacrylate, 5 parts by weight of zinc oxide, an adequate amount of barium sulfate, 0.3 parts by weight of bis(pentabromophenyl)disulfide, and 0.8 parts by weight of dicumyl peroxide. Half shells were formed from this resin composition. The center was covered with two of these half shells. The center and the half shells were placed into a mold that includes upper and lower mold halves each having a hemispherical cavity, and heated at 150° C. for 20 minutes to obtain a core with a diameter of 39.7 mm. The amount of the barium sulfate was adjusted such that the golf ball has a weight of 45.6 g.

A resin composition was obtained by kneading 50 parts by weight of an ionomer resin (the aforementioned trade name "Surlyn 8150"), 50 parts by weight of another ionomer resin (the aforementioned trade name "Himilan AM7329"), and 3 parts by weight of titanium dioxide with a twin-screw kneading extruder. The core was covered with this resin composition by injection molding to form a mid layer with a thickness of 1.0 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept, at 23° C. for 12 hours to obtain a reinforcing layer with a thickness of 10 μm.

A resin composition was obtained by kneading 100 parts by weight of a thermoplastic polyurethane elastomer (the aforementioned trade name "Elastollan XNY82A"), 0.2 parts by weight of TINUVIN 770, 4 parts by weight of titanium dioxide, and 0.04 parts by weight of ultramarine blue with a twin-screw extruder. Half shells were formed from this resin composition by compression molding. The sphere consisting of the core, the mid layer, and the reinforcing layer was covered with two of these half shells. The sphere and the half shells were placed into a final mold that includes upper and lower mold halves each having a hemispherical cavity and having a large number of pimples on its cavity face, and a cover was obtained by compression molding. The thickness of the cover was 0.5 mm. Dimples having a shape that is the inverted shape of the pimples were formed on the cover. A clear paint including a two-component curing type polyurethane as a base material was applied to this cover to obtain a golf ball of Example 1 with a diameter of approximately 42.7 mm and with a weight of approximately 45.6 g. The specifications of the dimples of the golf ball are shown in Table 5 below.

Examples 2 to 6 and Comparative Examples 1 to 4

Golf balls of Examples 2 to 6 and Comparative Examples 1 to 4 were obtained in the same method as Example 1, except the specifications of the core, the mid layer, the cover, and the dimples were as shown in Tables 6 and 7 below. The specifications of the core are shown in detail in Tables 1 and 2. The compositions of the mid layer are shown in detail in Table 3 below. The compositions of the cover are shown in detail in Tables 3 and 4 below. The specifications of the dimples are shown in detail in Table 5 below. Golf balls according to Examples 2, 5 and 6, and Comparative Example 3 do not include an envelope layer. The golf ball according to Comparative Example 1 has the same dimple pattern as that of Example described in JP2009-172192. The dimple pattern of the golf ball according to Comparative Example 1 does not have a region that is rotationally symmetrical.

[W#1]

A driver with a head made of a titanium alloy (trade name "XXIO", manufactured by DUNLOP SPORTS CO. LTD., shaft hardness: S, loft angle: 10°) was attached to a swing machine manufactured by Golf Laboratories, Inc. A golf ball was hit under the condition of a head speed of 45 m/sec, and the spin rate was measured. At the same time, the distance from the launch point to the stop point was measured. The average values of data obtained by 10 measurements are shown in Tables 6 and 7 below.

[I#5]

A #5-iron (trade name "SRIXON Z725", manufactured by DUNLOP SPORTS CO. LTD., shaft hardness: S, loft angle: 25°) was attached to a swing machine manufactured by Golf Laboratories, Inc. A golf ball was hit under the condition of a head speed of 41 m/sec, and the spin rate and the carry were measured. The carry is a distance from the launch point to the landing point. The average values of the spin rates obtained by 10 measurements are shown in Tables 6 and 7 below. The inverse numbers of differences between maximum values and minimum values of the carries obtained by the 10 measurements are shown as indices in Tables 6 and 7 below.

[I#9]

A #9-iron (trade name "SRIXON Z725", manufactured by DUNLOP SPORTS CO. LTD., shaft hardness: S, loft angle: 41°) was attached to a swing machine manufactured by Golf Laboratories, Inc. A golf ball was hit under the condition of a head speed of 39 m/sec, and the spin rate and the carry were measured. The average values of the spin rates obtained by 10 measurements are shown in Tables 6 and 7 below. The inverse numbers of differences between maximum values and minimum values of the carries obtained by the 10 measurements are shown as indices in Tables 6 and 7 below.

[SW]

A sand wedge (trade name "588RTX Chrome Wedge", manufactured by CLEVELAND GOLF, shaft hardness: S, loft angle: 58°) was attached to a swing machine manufactured by Golf Laboratories, Inc. A golf ball was hit under the condition of a head speed of 10 m/sec, and the spin rate was measured. The average values of the spin rates obtained by 10 measurements are shown in Tables 6 and 7 below.

TABLE 1

Compositions of Core (parts by weight)

| | a | b | c |
|---|---|---|---|
| Polybutadiene | 100 | 100 | 100 |
| Zinc diacrylate | — | 35 | 29.5 |
| Magnesium oxide | 35 | — | — |
| Methacrylic acid | 28 | — | — |
| Zinc oxide | — | 5 | 12 |
| Barium sulfate | — | * | * |
| 2-thionaphthol | — | — | 0.1 |
| Bis(pentabromophenyl)disulfide | — | 0.3 | 0.3 |
| Dicumyl peroxide | 0.9 | 0.8 | 0.85 |
| Benzoic acid | — | — | 2 |

* Adequate amount

TABLE 2

Specifications of Core

| | I | II | III | IV |
|---|---|---|---|---|
| Center | | | | |
| Composition | a | c | a | a |
| Temperature for crosslinking (° C.) | 150 | 150 | 150 | 150 |
| Time period for crosslinking (min) | 20 | 20 | 20 | 20 |
| Diameter (mm) | 1 | 39.7 | 15 | 15 |
| Envelope layer | | | | |
| Composition | b | — | b | b |
| Temperature for crosslinking (° C.) | 150 | — | 150 | 150 |
| Time period for crosslinking (min) | 20 | — | 20 | 20 |
| Diameter (mm) | 39.7 | — | 40.1 | 38.7 |
| Ho (Shore D) | 38 | 35 | 38 | 38 |
| Hs (Shore D) | 55 | 50 | 55 | 55 |
| Hs − Ho | 17 | 15 | 17 | 17 |

TABLE 3

Compositions of Mid layer and Cover (parts by weight)

| | a | b | c | d |
|---|---|---|---|---|
| Surlyn 8150 | 50 | — | 50 | — |
| Surlyn 9150 | — | — | 50 | — |
| Himilan 1605 | — | 47 | — | 29 |
| Himilan AM7329 | 50 | 50 | — | 50 |
| Rabalon T3221C | — | 3 | — | 21 |
| Titanium dioxide | 3 | 3 | 3 | 3 |
| Hm (Shore D) | 68 | 63 | 70 | 50 |

TABLE 4

Compositions of Cover (parts by weight)

| | A | B | C |
|---|---|---|---|
| Elastollan NY80A | — | 100 | — |
| Elastollan NY82A | 100 | — | — |
| Elastollan NY95A | — | — | 100 |
| TINUVIN 770 | 0.2 | 0.2 | 0.2 |
| Titanium dioxide | 4 | 4 | 4 |
| Ultramarine blue | 0.04 | 0.04 | 0.04 |
| Hc (Shore D) | 29 | 27 | 50 |

TABLE 5

| Specifications of Dimples | 1 | 2 |
|---|---|---|
| Front view | FIG. 2 | — |
| Plan view | FIG. 3 | — |
| Rotationally symmetrical angle (degree) | | |
| High-latitude region | — | — |
| Mid-latitude region | — | — |
| Low-latitude region | — | — |
| Pole vicinity region | 72 | — |
| Equator vicinity region | 60 | — |
| Dimple N1 | 324 | 384 |
| Occupation ratio (%) | 84.0 | 79.0 |
| Total volume ($mm^3$) | 325.2 | 325.0 |
| Plane N2 | 1 | 0 |
| Great circle path N3 | 0 | 0 |

TABLE 6

| Results of Evaluation | Ex. 1 | Ex. 2 | Ex. 3 | Ex. 4 | Ex. 5 |
|---|---|---|---|---|---|
| Core | I | II | III | I | II |
| Ho (Shore D) | 38 | 35 | 38 | 38 | 35 |
| (JIS C) | 62 | 54 | 62 | 62 | 54 |
| Hs (Shore D) | 55 | 50 | 55 | 55 | 50 |
| (JIS C) | 85 | 80 | 85 | 85 | 80 |
| Mid layer | a | b | a | b | b |
| Hm (Shore D) | 68 | 63 | 68 | 63 | 70 |
| Tm (mm) | 1.0 | 1.0 | 1.0 | 1.0 | 1.0 |
| Cover | A | B | A | A | B |
| Hc (Shore D) | 29 | 27 | 29 | 29 | 27 |
| Tc (mm) | 0.5 | 0.5 | 0.3 | 0.5 | 0.5 |
| Hb (Shore D) | 67 | 62 | 67.5 | 62 | 69 |
| Compression CD (mm) | 2.3 | 2.8 | 2.3 | 2.4 | 2.7 |
| Dimple | 1 | 1 | 1 | 1 | 1 |
| Hm − Hc | 39 | 36 | 39 | 34 | 43 |
| Hm − Hb | 1 | 1 | 0.5 | 1 | 1 |
| Hm − Ho | 30 | 28 | 30 | 25 | 35 |
| (Hm − Ho)/Hc | 1.04 | 1.03 | 1.04 | 0.86 | 1.29 |
| W#1 Spin (rpm) | 2400 | 2450 | 2300 | 2450 | 2350 |
| W#1 Flight distance (yard) | 280 | 278 | 284 | 278 | 282 |
| I#5 Spin (rpm) | 4500 | 4600 | 4400 | 4550 | 4500 |
| I#5 Stability | 100 | 100 | 100 | 100 | 100 |
| I#9 Spin (rpm) | 2550 | 2650 | 2450 | 2600 | 2600 |
| I#9 Stability | 100 | 105 | 100 | 100 | 105 |
| SW Spin (rpm) | 2400 | 2500 | 2350 | 2450 | 2400 |

TABLE 7

| Results of Evaluation | Ex. 6 | Comp. Ex. 1 | Comp. Ex. 2 | Comp. Ex. 3 | Comp. Ex. 4 |
|---|---|---|---|---|---|
| Core | II | I | IV | II | I |
| Ho (Shore D) | 35 | 38 | 38 | 35 | 38 |
| (JIS C) | 54 | 62 | 62 | 54 | 62 |
| Hs (Shore D) | 50 | 55 | 55 | 50 | 55 |
| (JIS C) | 80 | 85 | 85 | 80 | 85 |
| Mid layer | d | a | a | b | a |
| Hm (Shore D) | 50 | 68 | 68 | 63 | 68 |
| Tm (mm) | 1.0 | 1.0 | 1.0 | 1.0 | 1.0 |
| Cover | B | A | A | C | b |
| Hc (Shore D) | 27 | 29 | 29 | 50 | 63 |
| Tc (mm) | 0.5 | 0.5 | 1.0 | 0.5 | 0.5 |
| Hb (Shore D) | 49 | 67 | 58 | 62 | 63 |
| Compression CD (mm) | 2.9 | 2.3 | 2.3 | 2.8 | 2.3 |
| Dimple | 1 | 2 | 1 | 1 | 1 |
| Hm − Hc | 23 | 39 | 39 | 13 | 5 |

TABLE 7-continued

| Results of Evaluation | Ex. 6 | Comp. Ex. 1 | Comp. Ex. 2 | Comp. Ex. 3 | Comp. Ex. 4 |
|---|---|---|---|---|---|
| Hm − Hb | 1 | 1 | 10 | 1 | 5 |
| Hm − Ho | 15 | 30 | 30 | 28 | 30 |
| (Hm − Ho)/Hc | 0.55 | 1.04 | 1.04 | 0.56 | 0.48 |
| W#1 Spin (rpm) | 2500 | 2400 | 2600 | 2300 | 2250 |
| W#1 Flight distance (yard) | 276 | 280 | 272 | 284 | 286 |
| I#5 Spin (rpm) | 4650 | 4550 | 5000 | 4100 | 3900 |
| I#5 Stability | 100 | 80 | 100 | 100 | 100 |
| I#9 Spin (rpm) | 2750 | 2600 | 2800 | 2300 | 2100 |
| I#9 Stability | 105 | 103 | 100 | 105 | 100 |
| SW Spin (rpm) | 2400 | 2400 | 2600 | 2200 | 2000 |

As shown in Tables 6 and 7, each of the golf balls in Examples is excellent in various performance characteristics. From the results of evaluation, advantages of the present invention are clear.

The golf ball according to the present invention is suitable for playing golf on golf courses, practicing at driving ranges, and the like. The above description is merely for illustrative examples, and various modifications can be made without departing from the principles of the present invention.

What is claimed is:

1. A golf ball comprising a core, a mid layer positioned outside the core, and a cover positioned outside the mid layer, wherein the golf ball satisfies mathematical formulas (1) to (3) shown below, a large number of dimples are provided on a surface of the golf ball, when the surface is divided into a northern hemisphere and a southern hemisphere, each of the hemispheres includes a high-latitude region, a mid-latitude region and a low-latitude region, the high-latitude region has a latitude range of equal to or greater than 40° but equal to or less than 90°, the mid-latitude region has a latitude range of equal to or greater than 20° but less than 40°, and the low-latitude region has a latitude range of equal to or greater than 0° but less than 20°, one plane can divide the hemisphere dimple pattern into divided dimple patterns that have mirror symmetry with respect to each other, the high-latitude region has a dimple pattern that is not rotationally symmetrical, and the low-latitude region has a dimple pattern that is not rotationally symmetrical, and formulas (1) to (3) are as follows:

$$Hc \leq 49 \quad (1)$$

$$Hm - Hc \geq 15 \quad (2)$$

$$Hm - Hb \leq 2 \quad (3)$$

wherein Hm represents a Shore D hardness of the mid layer, He represents a Shore D hardness of the cover, and Hb represents a Shore D hardness of the surface of the golf ball.

2. The golf ball according to claim 1, wherein the mid layer is formed from a resin composition, and a principal component of a base resin of the resin composition is an ionomer resin, and the cover is formed from a resin composition, and a principal component of a base resin of the resin composition is a polyurethane.

3. The golf ball according to claim 1, wherein the cover has a thickness Tc of equal to or less than 0.8 mm.

4. The golf ball according to claim 3, wherein the thickness Tc of the cover is equal to greater than 0.3 mm but equal to or less than 0.5 mm.

5. The golf ball according to claim 1, wherein the hardness Hm is equal to or greater than 55.

6. The golf ball according to claim 1, wherein the golf ball satisfies mathematical formula (4) below:

$$0.6 \leq (Hm-Ho)/Hc \leq 1.5 \quad (4)$$

wherein Hm represents a Shore D hardness of the mid layer, Ho represents a Shore D hardness at a central point of the core, and He represents a Shore D hardness of the cover.

7. The golf ball according to claim 1, wherein the golf ball satisfies mathematical formula (5) below:

$$Hm-Ho \geq 20 \quad (5)$$

wherein Hm represents a Shore D hardness of the mid layer, and Ho represents a Shore D hardness at a central point of the core.

8. The golf ball according to claim 1, wherein the mid-latitude region dimple pattern is not rotationally symmetrical.

9. The golf ball according to claim 1, wherein the high-latitude region includes a pole vicinity region, the pole vicinity region has a latitude range of equal to or greater than 75° but equal to or less than 90°, and the pole vicinity region dimple pattern is rotationally symmetrical.

10. The golf ball according to claim 1, wherein the low-latitude region includes an equator vicinity region, the equator vicinity region has a latitude range of equal to or greater than 0° but less than 10°, and the equator vicinity region dimple pattern is rotationally symmetrical.

11. The golf ball according to claim 1, wherein a great circle that does not intersect any dimple does not exist on the surface.

12. The golf ball according to claim 1, wherein a ratio of a total area of the dimples to a surface area of a phantom sphere of the golf ball is equal to or greater than 80%.

13. The golf ball according to claim 9, wherein the pole vicinity region rotational angle is 60°, 72°, 90° or 120°.

14. The golf ball according to claim 10, wherein the equator vicinity region rotational angle is 60°, 72°, 90° or 120°.

* * * * *